US006279660B1

(12) United States Patent
Hay

(10) Patent No.: US 6,279,660 B1
(45) Date of Patent: Aug. 28, 2001

(54) APPARATUS FOR OPTIMIZING PRODUCTION OF MULTI-PHASE FLUID

(75) Inventor: Arthur D. Hay, Cheshire, CT (US)

(73) Assignee: Cidra Corporation, Wallingford, CT (US)

( * ) Notice: Subject to any disclaimer, the term of this patent is extended or adjusted under 35 U.S.C. 154(b) by 0 days.

(21) Appl. No.: 09/368,994

(22) Filed: Aug. 5, 1999

(51) Int. Cl.[7] ..... E21B 49/08

(52) U.S. Cl. ..... 166/336; 73/152.18; 73/649; 219/502; 250/227.14; 250/261; 385/12

(58) Field of Search ..... 166/113, 250.01, 166/336; 219/502; 250/227.11, 227.14, 236, 261; 73/152.18, 649; 385/12

(56) References Cited

U.S. PATENT DOCUMENTS 5,730,219 3/1998 Tubel et al. .
5,732,776 3/1998 Tubel et al. .
5,803,167 9/1998 Bussear et al. .
5,906,238 5/1999 Carmody et al. .
5,925,879 * 7/1999 Hay .
5,959,547 9/1999 Tubel et al. .
5,975,204 11/1999 Tubel et al. .
5,992,519 11/1999 Ramakrishnan et al. .
5,996,690 12/1999 Shaw et al. .
6,002,985 12/1999 Stephenson .
6,009,216 * 12/1999 Pruett et al. .

* cited by examiner

*Primary Examiner*—Roger Schoeppel
(74) *Attorney, Agent, or Firm*—McCormick, Paulding & Huber LLP

(57) ABSTRACT

A well assembly for extracting production fluids from at least one production zone of at least one well includes a production pipe for transporting fluid downstream to a surface, a packer for defining the production zone, and a fiber optic sensor package disposed substantially adjacent to a downstream side of the packer. The fiber optic sensor package measures parameters of the production fluid and communicates these parameters to the surface to determine composition of the production fluid entering the production pipe through each production zone. The production pipe has a zone opening for allowing the production fluid to enter the production pipe and a control valve for controlling the amount of production fluid flowing downstream from each production zone. The production pipe control valve is adjusted to optimize fluid production from the particular production zone of the well based on fluid parameters measured by the fiber optic sensor package.

14 Claims, 6 Drawing Sheets

APPARATUS FOR OPTIMIZING PRODUCTION OF MULTI-PHASE FLUID

BACKGROUND OF THE INVENTION

1. Technical Field

The present invention relates to multi-phase fluid measurement apparatus and, more particularly, to apparatus and method for measuring flow parameters and composition of a multi-phase fluid in a well environment.

2. Background Art

In oil and gas exploration industries, a production pipe is centered in a conventional well to carry production fluids to a surface platform. The production pipe may have a plurality of valves to regulate fluid flow from within the well. Each of the valves is typically adjustable using a sliding sleeve which is moved along the pipe to increase or decrease the size of an opening in the production pipe. The valves are typically adjusted mechanically or hydraulically by using a tubing-conveyed tool which is inserted into the well to adjust each valve.

It is highly desirable to optimize the total flow from the well since each well and/or portions thereof may contain differing compositions of water, gas, and oil. Currently, to optimize the total flow from the well, a trial-and-error technique is used to adjust each valve individually. Thus, a corresponding change in the total flow is measured to determine if the adjustment optimized the fluid flow. This process of optimizing fluid flow in the well is a very expensive, time consuming, and inaccurate and requires an interruption in well production during valve adjustments.

Thus, there is a need for an easily implemented and more efficient method and apparatus for measuring fluid parameters, such as composition of the production fluid, flow rate, pressure, and temperature to optimize production.

SUMMARY OF THE INVENTION

It is an object of the present invention to provide an apparatus for optimizing the production of a multi-phase fluid in a well without halting well production.

It is a further object of the present invention to provide an apparatus for retrofitting an existing well to optimize production of multi-phase fluids at various locations within the well.

It is another object of the present invention to optimize separation of production fluid in a separation tank.

It is yet another object of the present invention to optimize flow of production fluid from multiple zones within a single well bore.

It is yet another object of the present invention to use fiber optics to measure fluid parameters and minimize the use of electronic components downhole.

According to the present invention, a well assembly for extracting production fluids includes a production pipe for allowing production fluids to flow downstream to the surface having a plurality of production zones defined by a plurality of packers and a plurality of fiber optic sensor packages, each of which is associated with a respective production zone, for measuring flow parameters of the production fluid and communicating the flow parameters to the surface to determine composition of the production fluid entering each production zone. The production pipe also includes a zone opening corresponding to each production zone for allowing production fluid to enter the pipe and a control valve for each production zone to control the amount of production fluid flowing into the pipe from each production zone. Each fiber optic sensor package includes a fiber optic bus to communicate flow parameters and composition of the production fluid to the surface. Based on specific requirements and particular flow parameters communicated by the sensor packages, the control valves are adjusted to optimize production fluid flow from the production well.

According to one embodiment of the present invention, the well assembly includes sensor packages disposed in horizontal wells for determining flow parameters and optimizing flow of the production fluid in the well.

According to another embodiment of the present invention, the well assembly includes a sensor package for measuring exit flow from a boost pump used to maintain optimum flow rates from the well.

According to a further embodiment of the present invention, an existing well assembly is retrofitted with a plurality of sensor packages for determining composition and other parameters of fluid in various zones of the well to optimize production of fluid.

According to a further embodiment of the present invention, sensor packages are placed on each well in a multi-well network to optimize production of production fluid from multiple wells.

According to another embodiment of the present invention, the well assembly includes a plurality of sensor packages arranged to measure flow parameters of fluids entering and exiting a gas-liquid separation tank or a mud tank during drilling operations.

One advantage of the present invention is that the time consuming trial and error process of determining proper valve settings is avoided by installing flow meters within the well at specific locations to permit accurate measuring of the flow rates in various zones within the well.

Another advantage of the present invention is that flow rates within the well are readily measurable without halting well production.

These and other objects, features and advantages of the present invention will become more apparent in the light of the following detailed description of best mode embodiments thereof as illustrated in the accompanying drawings.

BEST MODE FOR CARRYING OUT THE INVENTION

Figure 1:
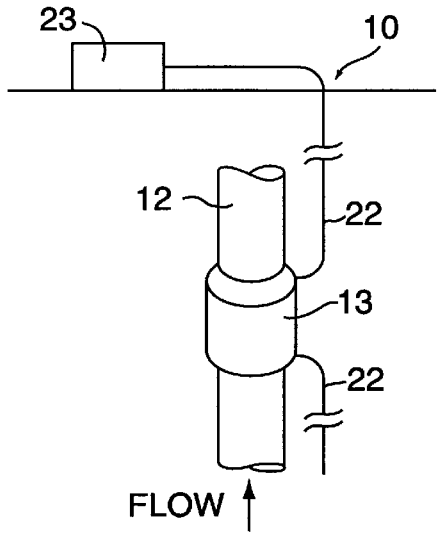
FIG. 1 is a schematic representation of a fiber optic sensor package for use with the present invention.

Referring to FIG. 1, a fiber optic sensor package 10 is fixed to a production pipe 12 for measuring fluid temperature, flow rate, pressure and liquid fraction. In the preferred embodiment of the present invention, the fiber optic sensor package includes optical fibers encased within a bundling or wrapper 13 around the production pipe 12, as disclosed in U.S. patent application Ser. Nos. 09/346,607 and 09/344,094 entitled, respectively, "Flow Rate Measurement Using Unsteady Pressures" and "Fluid Parameter Measurement in Pipes Using Acoustic Pressures", assigned to a common assignee and incorporated herein by reference. However, other types of fiber optic sensor packages can be used. The sensor package 10 is linked to other sensor packages via an optical fiber conduit 22 and routed to a demodulator 23.

Figure 2:
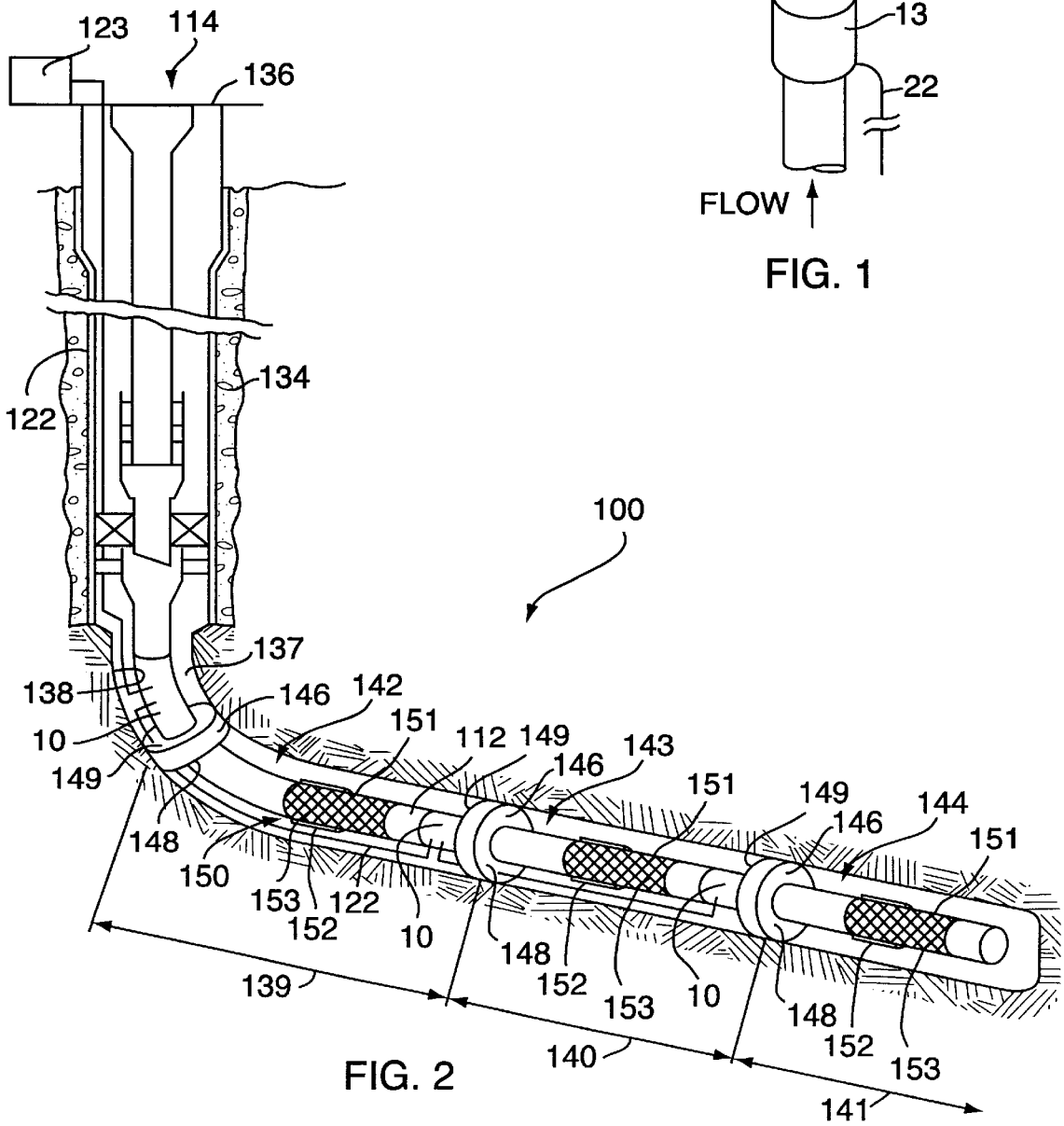
FIG. 2 is a schematic representation of one embodiment of the present invention showing a substantially horizontal, multi-zone well with one of a plurality of fiber optic sensor packages of the type shown in FIG. 1 associated with each zone.

Referring to FIG. 2, a single well configuration 100 includes a conventional substantially horizontal well 114 with a plurality of sensor packages 10 installed on a production pipe 112 centered in the well 114. A casing 134 extends from a surface platform 136 to a predetermined depth in the well to maintain the integrity of the upper portion of the well 114, with the casing 134 being typically fabricated from steel and supported with cement. Beyond the casing 134, the well is maintained as a bore 137 with rough well wall 138 extending to a desired depth. The production pipe 112 is centered in the bore 137 to transport production fluid flowing downstream from the bore 137 to the surface platform 136.

A portion of the well 114 producing production fluid is divided into production zones 139–141, designated as toe zone 139, center zone 140, and heel zone 141. The production pipe 112 is also divided into corresponding pipe zones 142–144 by a plurality of packers 146. Each packer 146 comprises an inflatable or mechanical annular seal extending from the well wall 138 to the production pipe 112 and having an upstream side 148 and downstream side 149, with production fluids flowing from the heel zone 141 downstream through the center and toe zones 140, 139, respectively, towards the surface platform 136. A sliding valve 150 is disposed at each of the pipe zones 142–144 and includes an opening 151 to allow fluid to flow from the bore 137 into the pipe 112 and a sleeve 152 that moves along the pipe 112 to incrementally adjust the sliding valve 150. The opening 151 has a screen 153 to prevent sand or large debris from entering the pipe 112.

The sensor packages 10 are placed on the downstream sides 149 of the packers 146 and the sliding valves 150 are placed on the upstream sides 148 of the packers in each zone 139–141. In the preferred embodiment, the sensor packages 10 are joined to one another with a fiber optic conduit 122 that transmits data to a demodulator 123 located at a surface platform 136, where the data is multiplexed according to known methods and described in the patent applications incorporated by reference. Alternatively, each sensor package 10 is equipped with its own fiber optic which is combined with fiber optics of other sensor packages and routed together to the surface platform 136.

In operation, production fluid from the toe zone 141 flows into the bore 137 and then enters the pipe 112 through the screen 153 of the sliding valve 150 disposed in the zone 144 of the pipe 112. Similarly, production fluids from the center and well zones 140, 139 flow into the pipe 112 through screens 153 of the sliding valves 150 disposed in the pipe zones 143, 142, respectively, of the pipe 112. As production fluid from each zone 141–139 enters the pipe 112, the flow parameters and composition of the fluid entering through that zone are measured. Each sensor package 10 senses parameters of the fluid flowing from all zones located upstream of the sensor package 10. Data from any sensor package 10 can be combined to determine the amount of fluid being contributed by any specific zone or zones in the well. For example, the flow in a particular zone is determined by subtracting the flow measured at the nearest upstream sensor package 10 from the flow measured at the nearest downstream sensor package 10. The resulting fluid flow is that produced by the zone in question.

To vary or eliminate fluid flow from a particular zone, the control valve 150 for that zone is adjusted to achieve the desired effect. Thus, the present invention allows adjustment of the valves based on the information communicated by the sensor packages 10, rather than based on conventional trial-and-error technique. Since the sensor packages 10 provide information regarding the composition of production fluid, including percentage of water from each particular zone, it is possible either to eliminate or partially eliminate flow from zones that produce more water than desired. Therefore, the present invention allows optimization of production from a particular well or zone within a well.

Figure 3:
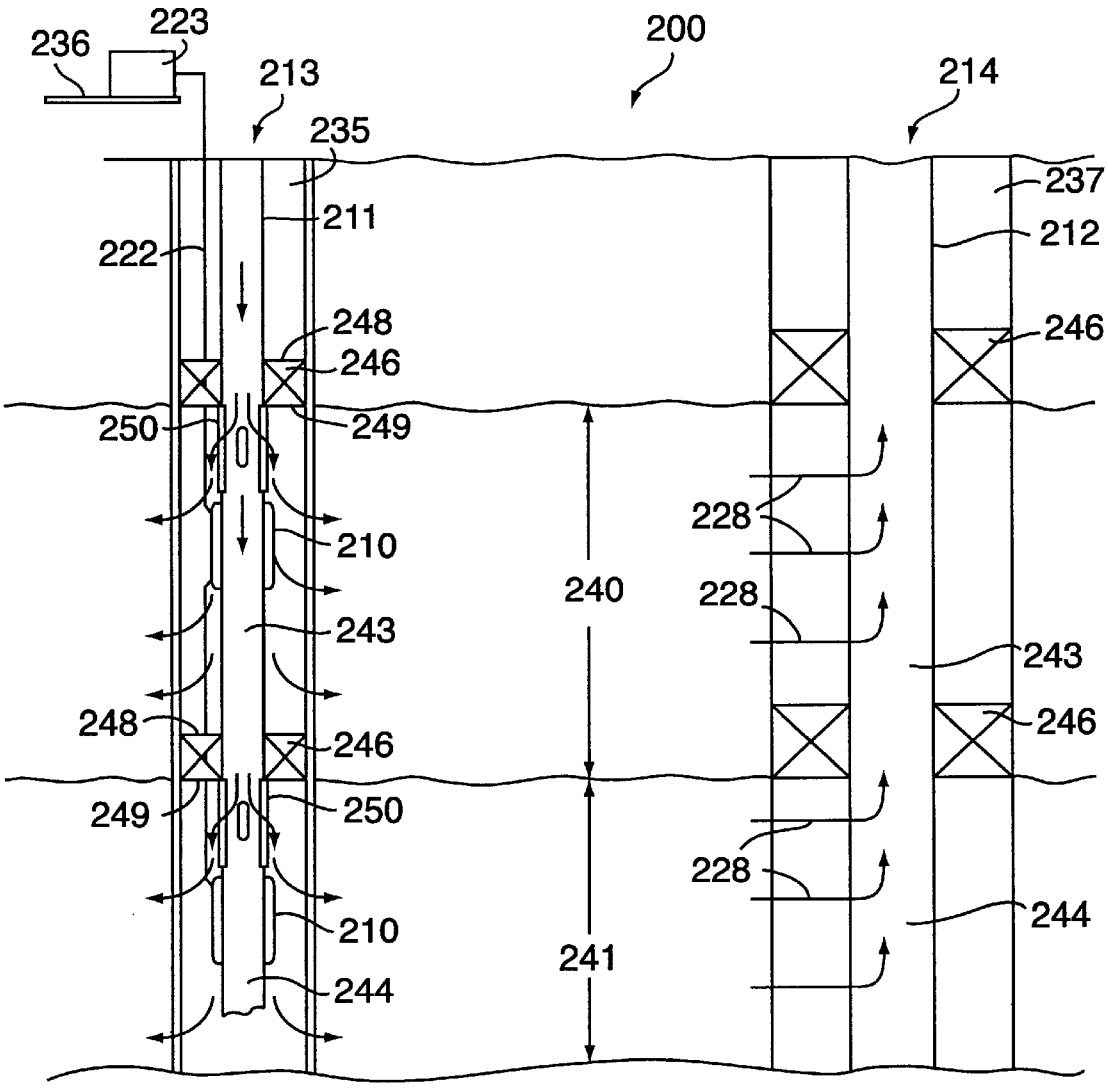
FIG. 3 is a schematic representation of a second embodiment of the present invention showing a water injection well and a production well and fiber optic sensor packages of the type shown in FIG. 1 placed within the water injection well to measure flow rates of water at various well locations and within the production well to optimize production of production fluid.

Referring to FIG. 3, a double well configuration 200 includes first and second wells 213, 214 divided into a plurality of production zones 240, 241. Each well 213, 214 includes first and second production pipes 211, 212 also divided into corresponding pipe zones 243, 244, with each pipe centered, respectively, in first and second bores 235, 237. Inflatable or mechanical packers 246 define production zones 240, 241. Each packer 246 includes an upstream side 248 and a downstream side 249.

The first production pipe 211 has a plurality of sliding valves 250, each of which is placed on the downstream side 249 of a corresponding packer 246 to control water flowing downstream from the surface platform 236 through the first production pipe 211 into the respective production zones 240, 241 of the first well 213. The first production pipe 211 also includes a plurality of sensor packages 210 to measure flow rates of water which is pumped into the first well 213 to pressurize production fluid to be extracted from the second well 214. Sensor packages 210 are disposed downstream of each sliding valve 250 in the first well 213 and are joined to one another with a fiber optic conduit 222 which transmits sensor data to the demodulator 223. The second well 214 includes corresponding pipe zones 243, 244 of the second pipe 212 for flowing production fluids downstream from the well zones 241, 240 toward the platform surface 236. The second well 214 may also include a plurality of sensor packages (not shown) and a plurality of sliding valves for measuring amount and composition of the production fluid and for controlling intake of the production fluid 228 from each well zone 241, 240, as shown in FIG. 2.

In operation, the water is pumped downstream into the first well 213 from the surface platform 236 and is allowed to enter each zone 240, 241 through respective sliding valves 250. The amount of water pumped into each zone 240, 241 through the first well 213 is monitored by the sensor packages 210 disposed on the first pipe 211. As pressurized water enters each zone 240, 241, the water encourages production fluid to flow into the second well 214 through the plurality of sliding valves disposed on the second pipe 212 (not shown). The amount and composition of the production fluid is monitored by the sensor packages disposed on the second production pipe 212. Depending on the amount and composition of the production fluid flowing from the second pipe 212, the water pressure and amount of water entering each zone 240, 241 through the pipe 211 is controlled by adjusting the sliding valves 250 disposed on the pipe 211 to optimize production of the production fluid through the pipe 212. The amount of production fluid flowing into the second pipe 212 of the second well 214 can be optionally controlled by the sliding valves disposed on the second pipe 212 based on the information communicated by sensor packages disposed on the second pipe 212.

Figure 4:
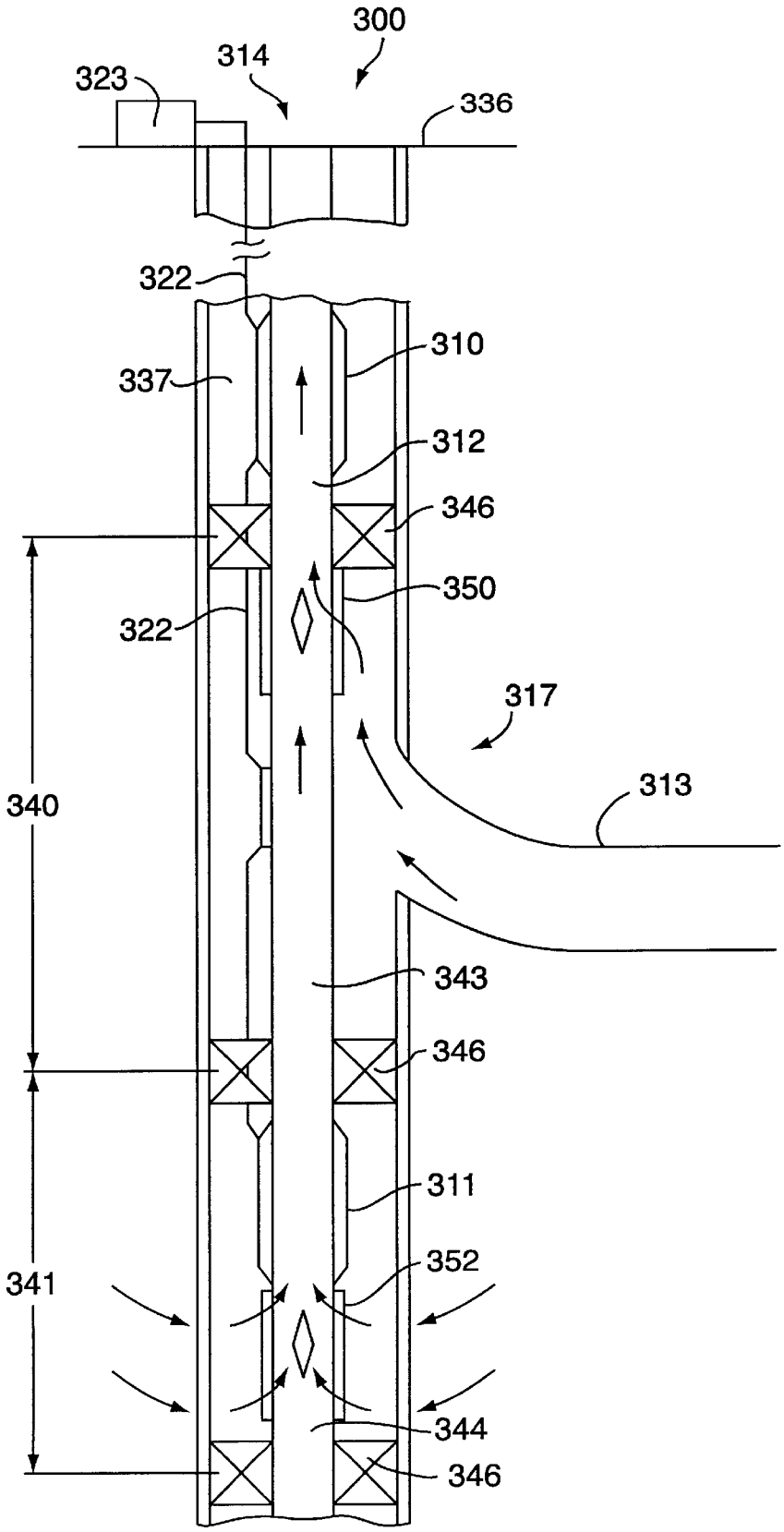
FIG. 4 is a schematic representation of a third embodiment of the present invention showing fiber optic sensor packages of the type shown in FIG. 1 installed to optimize flow of production fluid from a well with a lateral zone.

Referring to FIG. 4, a multi-lateral well configuration 300 includes a lateral well 313 and a main well 314. A confluence zone 317 is defined at a junction of the lateral well 313 and the main well 314. The main well 314 has a bore 337 which is divided into production zones 340, 341 with a main production pipe 312 centered in the bore 337. The main production pipe 312 is divided into corresponding pipe zones 343, 344 with a plurality of packers 346 disposed therebetween. A first sliding valve 350 is disposed in the main production pipe 312 to control fluid flow into the main production pipe 312 from the lateral well 313 and the production zones 340, 341. A first sensor package 310 is positioned downstream of the production zone 340 to measure the combined flow traveling downstream to the surface platform 336.

The multi-lateral well configuration 300 also includes a second sliding valve 352 and a second sensor package 311 disposed on the main pipe 312 with the production zone 341, downstream of the confluence zone 317.

In operation, fluid flowing from production zone 341 enters the main pipe 312 through the second sliding valve 352 and is measured by the second sensor package 311. Production fluid from the lateral well 313 and from the production zone 340 is measured by the first sensor package 310. Data from the sensor packages 310, 311 can be transmitted via a fiber optic conduit 322 to the surface platform 336 and multiplexed by demodulator 323. To determine the fluid parameters of the flow coming from the lateral zone 313, the flow measurements taken at the first sensor package 310 are subtracted from those measurements taken at the second sensor package 311. The sliding valves 350, 352 can be adjusted appropriately to increase or decrease flow coming from various zones.

Figure 5:
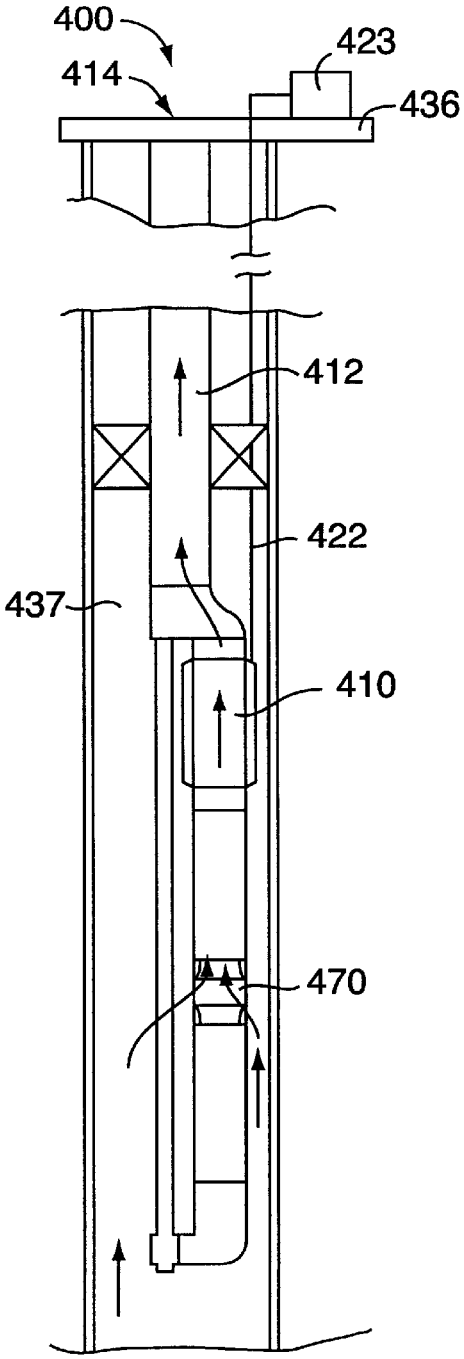
FIG. 5 is a schematic representation of a fourth embodiment of the present invention showing fiber optic sensor packages of the type shown in FIG. 1 installed to measure fluid flow at an exit of a boost pump to optimize flow in a production pipe.

Referring to FIG. 5, a well configuration 400 includes a production pipe 412 centered in bore 437 of a well 414. A submersible electric boost pump 470 is installed in the production pipe 412 to maintain a desired production fluid flow rate. A sensor package 410 measures fluid flow exiting the boost pump 470. A fiber optic conduit 422 routes data from the sensor package 410 to the demodulator 423 on surface platform 436. Data from the sensor package 410 is used to monitor pump performance and to obtain true measurements of a multi-phase liquid passing through the production pipe in the area of the pump.

Figure 6:
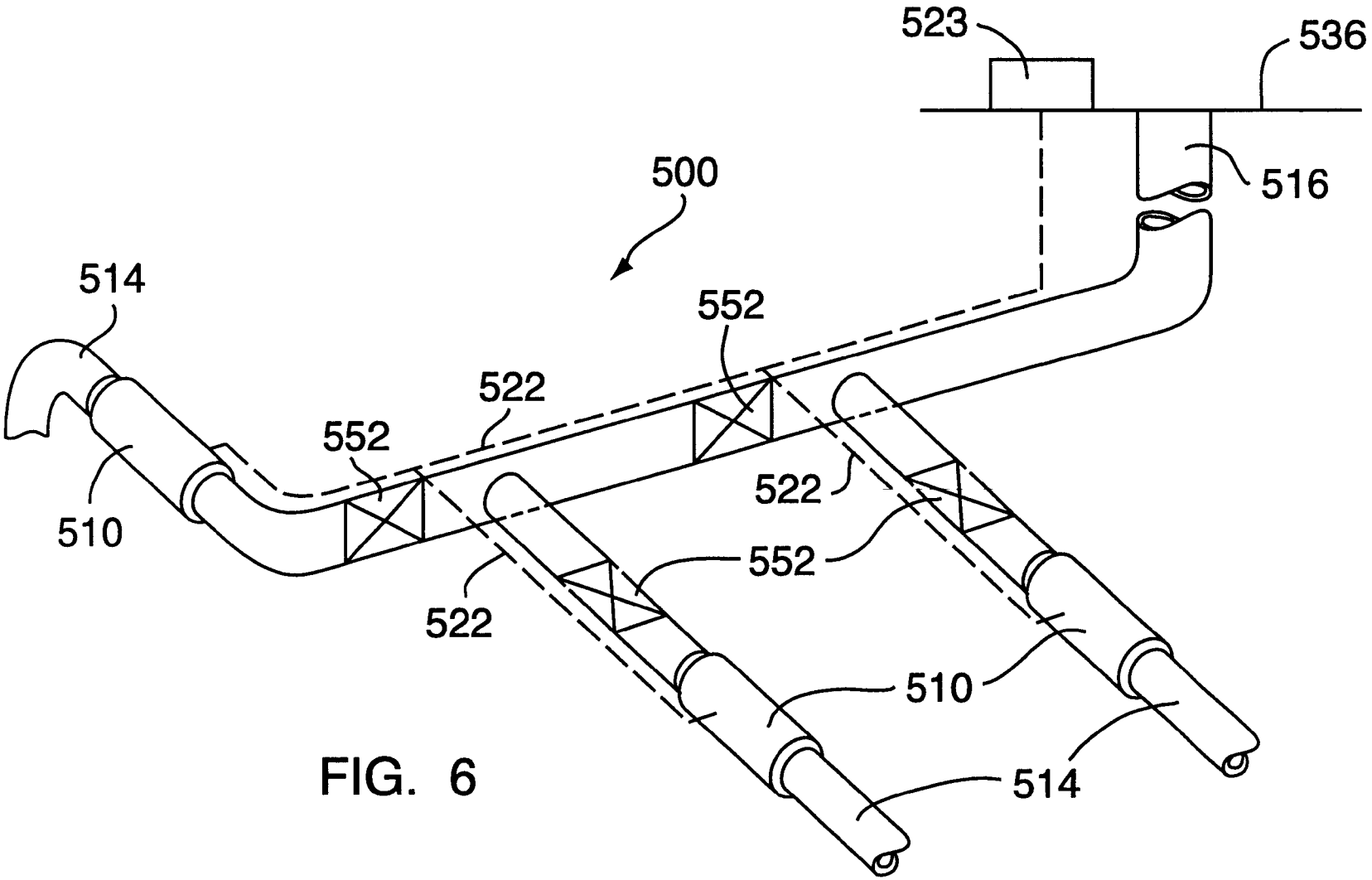
FIG. 6 is a schematic representation of a fifth embodiment of the present invention showing fiber optic sensor packages of the type shown in FIG. 1 installed to measure flow of a production fluid in a plurality of production pipes before the pipe flows are commingled.

Referring to FIG. 6, a multi-well network 500 includes a plurality of well outlet pipes 514 directing flow of production fluid from each respective well into a main collection pipe 516. Each well outlet pipe 514 includes a valve 552 and a sensor package 510 to determine flow from each well. The sensor packages 510 are connected to each other using a fiber optic conduit 522 which transmits the data to the demodulator 523 located at surface platform 536.

In operation, flow rates in each of the production pipes 514 can be measured before the fluid from each pipe is commingled. In this manner, fluid flow from certain production pipes 514 can be shut down completely or partially and optimal production can be achieved.

Figure 7:
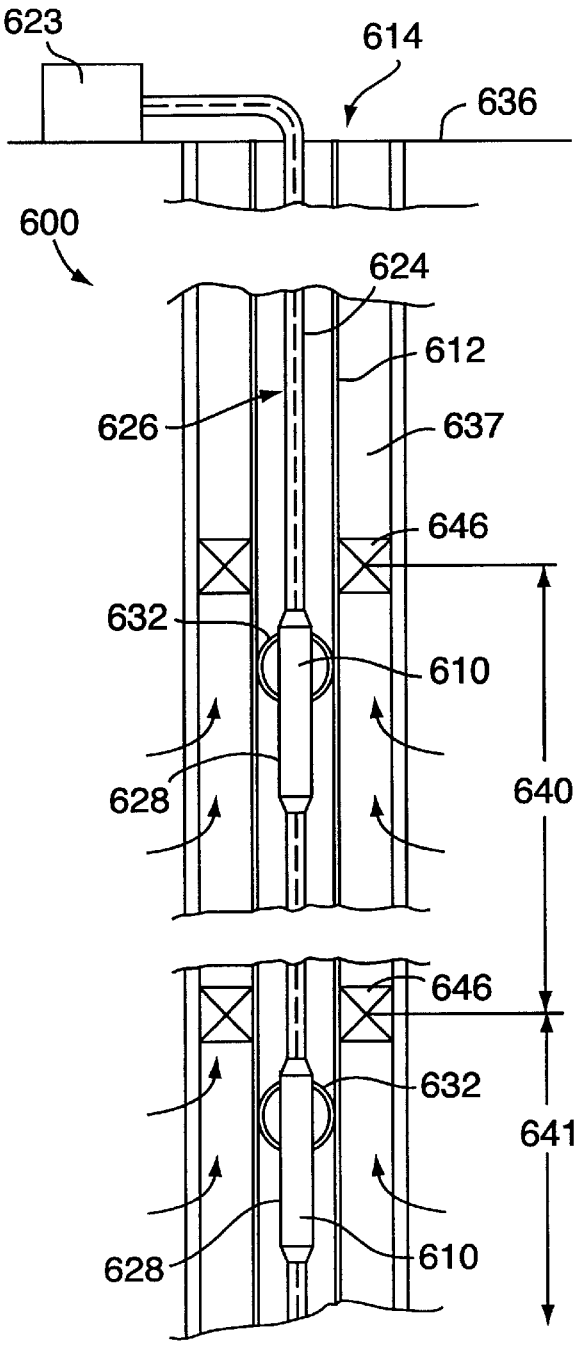
FIG. 7 is a schematic representation of a sixth embodiment of the present invention installed to measure flow in an existing well temporarily retrofitted with fiber optic sensor packages of the type shown in FIG. 1 deployed using coil tubing.

Referring to FIG. 7, an existing well configuration 600 includes a well 614 retrofitted with a plurality of sensor packages 610 having fluid measurement capabilities. The well 614 has a production pipe 612 centered in a bore 637 and packers 646 separating the production pipe 612 into production zones 640, 641. The sensor packages 610 are connected in series by a coiled tube 624 to form a sensor harness 626, which is then inserted into the production pipe 612. The tube 624 contains a fiber optic conduit to transmit sensor data to the demodulator 623 disposed on a platform 636. Each of the sensor packages 610 is placed in a protective container 628 and centered within the production pipe 612 using bow springs 632. Other techniques for centralizing sensor packages are known and acceptable for use.

In operation, the existing well 614 can be retrofitted with the plurality of sensor packages 610 to determine properties of the fluid flowing from production zones 640, 641. The bow springs 632 ensure that the sensor packages 610 are centered with respect to the production pipe 612. Thus, even the production in the existing wells can be optimized without interfering with the continuous fluid flow.

Figure 8:
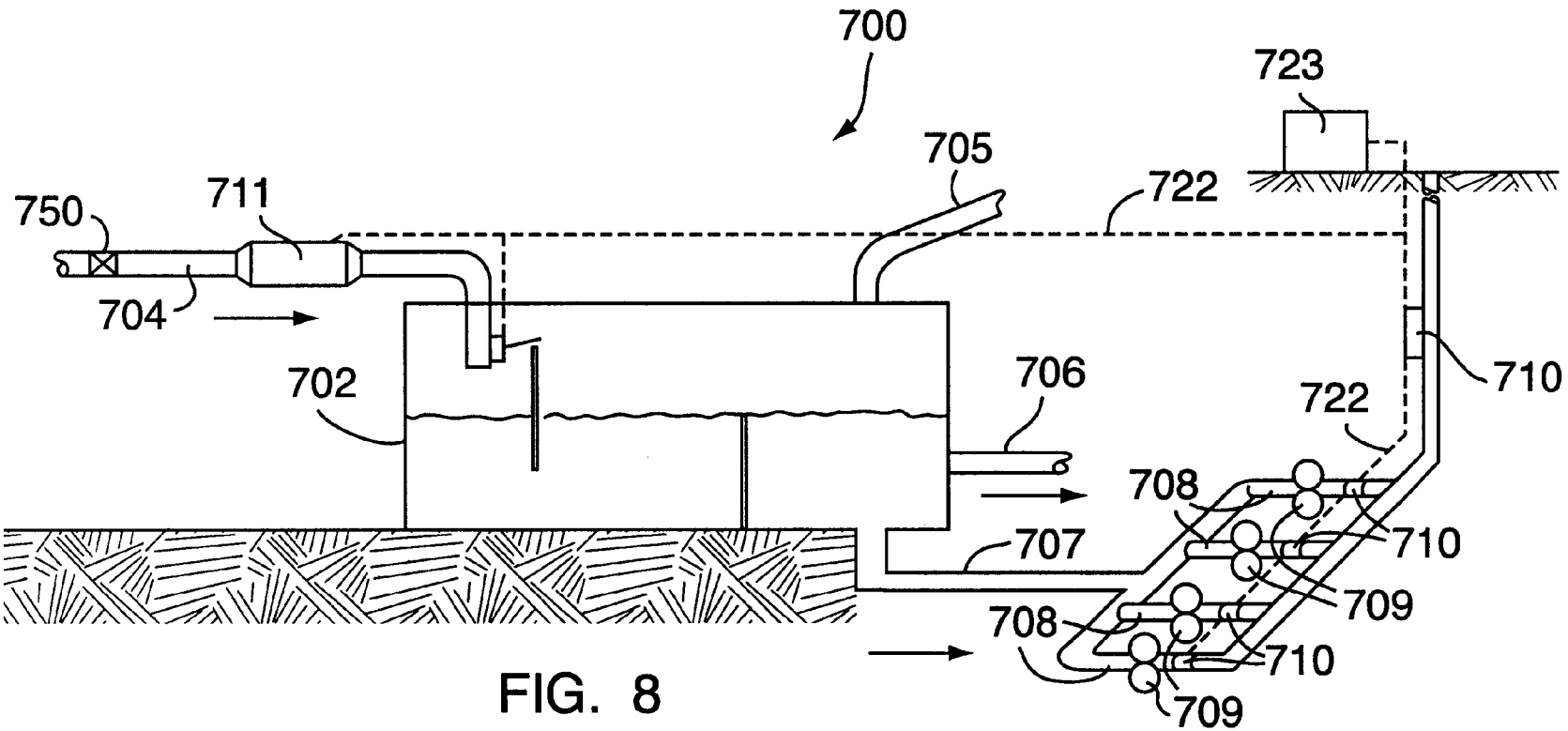
FIG. 8 is a schematic representation of a sixth embodiment of the present invention with fiber optic sensor packages of the type shown in FIG. 1 installed in a production pipe and outlet pipes to measure flow rates entering and exiting a liquid fraction apparatus installed on a sea bed.

Referring to FIG. 8, a fluid separation system 700 for separating oil, gas, water, and mud includes a fluid separation tank 702 having an entrance pipe 704, a gas outlet pipe 705, an oil outlet pipe 706, and a discharge pipe 707 for water and mud. The discharge pipe 707 is divided into several secondary discharge pipes 708, each of which is fitted with a pump 709. A sensor package 710 is located immediately downstream of each pump 709 to measure fluid flowing through the corresponding pump. Data from the sensor packages 710 is transmitted through a fiber optic conduit 722 to the demodulator 723. The system 700 also includes a second sensor package 711 and control valve 750 disposed on the entrance pipe 704.

In operation, production fluid flows through the entrance pipe 704 into the separator tank 702 where it is separated and directed to pumps 709 and outlet pipes 705, 706. The gas and oil are directed through the gas and oil outlet pipes 705, 706 and the waste (water and mud) is channeled into the discharge pipe 707. The second sensor package 711 provides information regarding production fluid inflow into the separation tank 702. Depending on various requirements, the control valve 750 can be adjusted to optimize inflow of the production fluid into the separation tank 702. The sensor packages 710 provide information regarding flow parameters in the secondary discharge pipes 708. The data from sensor packages 710 located at pump outlets is also used to monitor efficiencies of the pumps 709. The fluid separation system 700 of the present invention optimizes production fluid separation and monitors efficiency of the pumps 709.

The fiber-optic based sensor packages are constructed by coiling optical fiber on the production pipe. In addition, the production pipe can be manufactured with optical fiber incorporated into the pipe material, as discussed in the references cited herein. For all of the embodiments except the embodiment shown in FIG. 7, the sensor packages are fixed to the production pipe prior to installation of the pipe in the well. For the embodiment shown in FIG. 7, each of the sensor packages is installed into a protective container and used for retrofitting the existing well installations. Each of the embodiments shown is expandable to accommodate a larger number of production zones or sensor packages.

One advantage of the present invention is that the trial and error technique of adjusting valve positions is no longer necessary. Fluid flow in any one of the production pipe can be easily and accurately determined with a fiber optic-based sensor package installed on the production pipe, and a correct valve position can be calculated accordingly.

Another advantage of the present invention is that the efficiency of individual pumps can be monitored without removing and examining the pump.

While preferred embodiments have been shown and described above, various modifications and substitutions may be made without departing from the spirit and scope of the invention. For example, use of any compatible flowmeter is considered within the scope of the present invention. Additionally, combinations of the various embodiments discussed herein, to include more numerous production pipes and production zones, are considered within the scope of the invention, as is the use of transmitting means other than fiber optic conduit. Accordingly, it is to be understood that the present invention has been described by way of example and not by way of limitation.

I claim:

1. A well assembly for extracting production fluid having a production pipe for allowing said production fluid to flow downstream to surface, said well assembly comprising:

a first production zone defined by a first packer disposed on a downstream end of said first production zone, said first packer having an upstream first packer side and a downstream first packer side, said first production zone having a first zone opening disposed in said production pipe for allowing said production fluid to enter said production pipe and a first control valve for controlling amount of said production fluid flowing downstream from said first production zone, said first production zone also having a first fiber optic sensor package disposed substantially adjacent to said downstream first packer side for measuring parameters of said production fluid and communicating said parameters to said surface to determine composition of said production fluid entering said production pipe through said first production zone.

2. The well assembly according to claim 1 further comprising:

a water well for flowing pressurized water downstream from surface into said first production zone, said water well having a water pipe equipped with a water control valve for controlling the amount of water exiting said water pipe and a second fiber optic sensor package disposed downstream from said water control valve for measuring the flow of water from said water pipe to determine whether said water control valve requires adjustment.

3. The well assembly according to claim 1 further comprising:

a second production zone disposed downstream from said first production zone and separated therefrom by said first packer, said second production zone having a second zone opening for allowing production fluid to enter said production pipe and a second control valve for controlling amount of said production fluid flowing downstream from said first production zone and said second production zone, said second production zone having a second packer disposed on a downstream end of said second production zone, said second packer having an upstream second packer side and a downstream second packer side, said second production zone having a second fiber optic sensor package disposed substantially adjacent said downstream second packer side for measuring parameters of said production fluid and communicating said parameters to said surface to determine composition of said production fluid entering said production pipe through said first production zone and said second production zone.

4. The well assembly according to claim 3 further comprising:

a water well for flowing pressurized water from surface downstream into said first and second production zones, said water well having a water pipe equipped with a first and a second water control valve for controlling the amount of water exiting said water pipe into said first and second production zones, respectively, and a first and a second fiber optic sensor package disposed downstream from said first and second control valves, respectively, for measuring the amount of water from said water pipe into said first and second production zones to determine whether said first and second control valves require adjustment.

5. The well assembly according to claim 3 further comprising:

a third production zone disposed downstream from said second production zone and separated therefrom by said second packer, said third production zone having a third zone opening for allowing production fluid to enter said production pipe and a third control valve for controlling amount of said production fluid entering said production pipe through said third production zone, said third production zone having a third packer disposed on a downstream end thereof, said third packer having an upstream third packer side and a downstream third packer side, said third production zone having a third fiber optic sensor package disposed substantially adjacent said downstream third packer side for measuring parameters of said production fluid and communicating said parameters to said surface to determine composition of said production fluid entering said production pipe through said first production zone, said second production zone and said third production zone.

6. The well assembly according to claim 3 wherein said second zone is a lateral zone.

7. The well assembly according to claim 1 further comprising:

a second production zone laterally spaced from said first production zone, said second production zone having a second zone opening for allowing said production fluid to enter a second production pipe and a second control valve for controlling amount of said production fluid flowing through said second production zone, said second production zone having a second packer disposed on a downstream end of said second production zone, said second packer having an upstream second packer side and a downstream second packer side, said second production zone having a second fiber optic sensor package disposed substantially adjacent said downstream second packer side for measuring parameters of said production fluid and communicating said parameters to said surface to determine composition of said production fluid entering said production pipe through said second production zone.

8. The well assembly according to claim 1 wherein said first production zone also includes a pump for pumping said production fluid downstream toward said surface.

9. A well assembly for flowing production fluids from a well downstream to surface, said well assembly comprising:

a production pipe having a plurality of production zones, each of said plurality of production zones being separated from another said production zone; and a plurality of fiber optic sensor packages with each of said plurality of sensor packages being disposed on one of said production pipes in each of said production zones for determining various parameters of said production fluid.

10. The well assembly according to claim 9 further comprising:

a plurality of control valves with each of said plurality of control valves being disposed on one of said production pipes in each of said production zones for optimizing flow of said production fluid through each of said production zones.

11. The well assembly according to claim 10 wherein each of said plurality of fiber optic sensor packages comprises temperature and pressure transducers and a liquid fraction sensor.

12. The well assembly according to claim 10 wherein each of said plurality of fiber optic sensor packages being connected by a data transmitting means to a data processor.

13. The well assembly according to claim 12 wherein said data processor means is a demodulator.

14. The well assembly according to claim 12 wherein said data transmitting means is a fiber optic conduit.

* * * * *